United States Patent [19]

Neuroth

[11] 4,454,377

[45] * Jun. 12, 1984

[54] OIL WELL CABLE

[75] Inventor: David H. Neuroth, Bethany, Conn.

[73] Assignee: Harvey Hubbell Incorporated, Orange, Conn.

[ * ] Notice: The portion of the term of this patent subsequent to Oct. 11, 2000 has been disclaimed.

[21] Appl. No.: 390,308

[22] Filed: Jun. 21, 1982

[51] Int. Cl.[3] ..... H01B 7/18

[52] U.S. Cl. ..... 174/103; 174/102 SP; 174/106 R; 174/109; 174/117 F

[58] Field of Search ..... 174/15 C, 102 SP, 103, 174/106 R, 108, 109, 117 F, 47

[56] References Cited

U.S. PATENT DOCUMENTS

| | | | |
|---|---|---|---|
| 1,740,076 | 12/1929 | Delon | 174/103 |
| 1,822,624 | 9/1931 | Hoeftmann | 138/120 |
| 2,165,738 | 7/1939 | Van Hoffen | 174/105 R |
| 2,391,037 | 12/1945 | Shafer, Jr. | 174/102 SP |
| 2,483,301 | 9/1949 | Roberds | 174/15 |
| 2,544,233 | 3/1951 | Kennedy | 174/117 R X |
| 2,849,526 | 8/1958 | Brockbank | 174/107 |
| 2,897,253 | 7/1959 | Davey et al. | 174/109 X |
| 3,351,706 | 11/1967 | Gnerre et al. | 174/105 R |
| 4,196,307 | 4/1980 | Moore et al. | 174/47 |
| 4,277,642 | 7/1981 | Piper et al. | 174/117 R X |
| 4,282,398 | 8/1981 | Solomon | 174/106 R |
| 4,374,530 | 2/1983 | Walling | 174/47 X |

FOREIGN PATENT DOCUMENTS

| | | | |
|---|---|---|---|
| 1020074 | 11/1957 | Fed. Rep. of Germany | 174/117 R |
| 2163351 | 6/1973 | Fed. Rep. of Germany . | |
| 437525 | 10/1935 | United Kingdom . | |
| 1242494 | 8/1971 | United Kingdom . | |
| 1250823 | 10/1971 | United Kingdom | 174/136 |
| 1387180 | 3/1975 | United Kingdom . | |
| 2069746 | 8/1981 | United Kingdom . | |

*Primary Examiner*—J. V. Truhe
*Assistant Examiner*—Morris H. Nimmo
*Attorney, Agent, or Firm*—Jerry M. Presson

[57] ABSTRACT

Disclosed is a flat, electrical cable for use in extremely adverse environments, such as found in oil wells, comprising a plurality of conductors individually sheathed in insulation. The cable includes an elongated, compression-resisting member positioned adjacent an insulated conductor, the member being slotted laterally to impart a degree of bending thereto. A bendable liner is mounted between the member and the insulation sheath of the adjacent conductor to bridge the slots and thereby protect adjacent insulation from abrasion by edges formed on the member by the slots during bending.

18 Claims, 5 Drawing Figures

OIL WELL CABLE

This invention relates to an electrical cable and more particularly, to a cable for use in an extremely adverse environment, such as those encountered in oil wells.

BACKGROUND OF THE INVENTION

Electrical cables which are used in oil wells must be able to survive and perform satisfactorily under extremely adverse conditions of heat and mechanical stress. Ambient temperatures in wells are often high and the $I^2R$ losses in the cable itself add to the ambient heat. The service life of a cable is known to be inversely related to the temperature at which it operates. Thus, it is important to be able to remove heat from the cable while it is in its operating environment.

Cables are subjected to mechanical stresses in several ways. It is common practice to attach cables to oil pump pipes to be lowered into a well using bands which can, and do, crush the cables, seriously degrading the effectiveness of the cable insulation and strength. The cables are also subjected to axial tension and lateral impact during use.

It is therefore conventional to provide such cables with external metal armor and to enclose the individual conductors within layers of materials chosen to enhance the insulation and strength characteristics of the cable, but such measures are sometimes not adequate to provide the necessary protection.

An additional problem arises as a result of down-hole pressures, which can be in the hundreds or thousands of pounds per square inch, to which the cables are subjected. Typically, the insulation surrounding the conductors in a cable contains micropores into which gas is forced at these high pressures over a period of time. Then, when the cable is rather quickly extracted from the wall, there is not sufficient time for the intrapore pressure to bleed off. As a result, the insulation tends to expand like a balloon and can rupture, rendering the cable useless thereafter.

In U.S. Pat. No. 4,409,431 in which the assignee is the same as the assignee of the instant invention, there is described a cable structure which is particularly suitable for use in such extremely adverse environments. The structure protects the cable against compressive forces and provides for the dissipation of heat from the cable which is an important feature in high temperature operating environments, for reasons discussed therein.

As described in said copending application, the cable protective structure includes one or more elongated support members which conform to, and extend parallel and adjacent an insulated conductor comprising the cable. The members are rigid in cross-section to resist compressive forces which would otherwise be borne by the cable conductors. For applications requiring the cable to undergo long-radius bends in service, the elongated support may be formed with a row of spaced-apart slots which extend perpendicularly from the one edge of the support member into its body to reduce the cross-sectional rigidity of the member in the slotted areas so as to provide flexibility in the support to large-radius bending about its longitudinal axis.

For certain service applications, it may be preferred that the electrical insulating jacket on a cable conductor not be in direct contact with the slot openings. This is because the slot openings in the support member may allow highly corrosive materials to gain access to the jacket composition by flowing inwardly through the slots. In addition, the corners formed by the slots may cut into or abrade the underlying cable jacket upon repeated bending of the cable.

BRIEF DESCRIPTION OF THE INVENTION

An object of the present invention is to provide a cable protective structure which includes an elongated, bendable support member for protecting an underlying layer of conductor insulation from compressive forces and abrasion caused by bending of the member.

Another object of this invention is to provide an elongated cable protective structure which is a composite of an outer bendable portion formed of a plurality of interconnected sections of rigid cross-section for protecting an underlying conductor from compressive forces and an inner element for protecting the conductor against abrading contact with the compression-resisting sections.

Still another object of this invention is to provide an elongated, bendable cable protective structure which is comprised of a composite of two parts; an outer channel of rigid cross-section for protecting internal cable conductors against transversely-applied compressive forces and adapted to bend about its longitudinal axis, and an inner liner which is bendable with the outer channel for protecting the insulation on the conductors from abrasion and/or adverse chemicals or environments.

Yet another object is to provide a composite cable protective structure in accordance with the foregoing objects, for use in down-hole oil wells which is made thermally conductive to dissipate heat received by the cable in such environments.

Still yet another object of this invention is to provide an electrical cable protective structure housed within the protective jacket of the cable which is made of an assemblage of two components to simplify the manufacture of the protective structure.

DETAILED DESCRIPTION OF THE INVENTION

Figure 1:
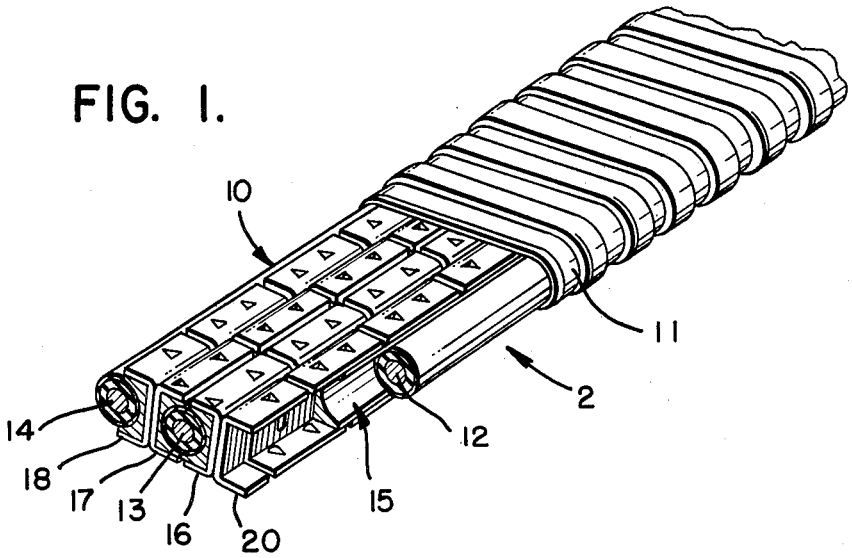
FIG. 1 is a partial perspective sectional view of a length of cable constructed in accordance with this invention, illustrating an end portion with its outer protective jacket removed.

FIG. 1 illustrates one embodiment of a cable constructed in accordance with the present invention which is particularly suitable for down-hole or oil well applications. The cable 10 illustrated therein includes an exterior metal protective jacket 11 which surrounds and encloses a plurality of individually insulated conductors 12, 13 and 14. For down-hole applications, the conductors are arranged so that the central axes of the conductors lie parallel and in essentially the same plane providing the cable with a preferred flat shape.

The jacket 11 is typically formed of metal corrugations wrapped about the conductors 12, 13 and 14 in helical fashion. The juxtaposed conductors are of considerable length, as needed, it being understood that only a very short length of the cable is illustrated in FIG. 1. Interposed between the insulated conductors are four support members 15, 16, 17 and 18, each of the support members being elongated and extending parallel to the conductors.

The support members 15, 16, 17 and 18 are made of a material which is substantially rigid in cross-section and which is selected to have good thermal conductivity properties; specifically, a thermal conductivity which is at least greater than the thermal conductivity of the conductor insulation. Fiber-filled carbon compositions are suitable for this purpose, and also exhibit good compression resistance. Metals such as steel and aluminum are also suitable for this purpose, as are metal-filled curable polymeric materials.

A channel 20 for each of the support members 15, 16, 17 and 18 may be punched from a single, continuous strip of U-shape channel material and hence, each length of channel 20 will be of substantially identical cross-sectional size and shape. Such being the case, a description of the channel 20 for one support member, namely member 15, will suffice to also describe its nature and usage in counterpart support members 16, 17 and 18.

Figure 2:
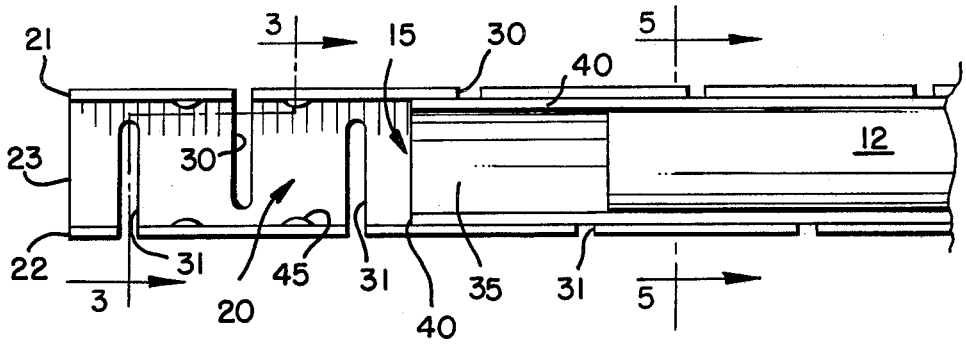
FIG. 2 is a side elevational view of the one end portion of the cable of FIG. 1 as viewed in the direction of arrow 2 of FIG. 1.
Figure 3:
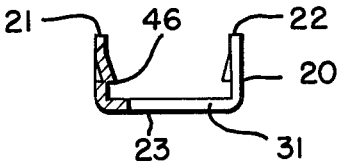
FIG. 3 is a sectional end view of a compression-resisting channel member for use in the instant cable, taken along section line 3—3 of FIG. 2.

The channel 20 is essentially of U cross-sectional shape formed by upper and lower legs 21 and 22, respectively, which are substantially flat, parallel and horizontal as viewed in FIG. 2 so that they conform to the respective upper and lower flat surfaces of the metallic jacket 11. The lateral legs of the support members are joined by a rigid, vertical leg 23 which is slightly longer than the overall diameter of the conductor and its covering layer or layers of insulation. As will be seen, the cross-sectional shape of the support is that of a substantially U-shaped channel with the legs 21 and 22 extending approximately to the center of the adjacent conductor which faces the U of the channel. Hence, the legs 21 and 22 extend from the joining leg 23 to each side of this conductor a distance which is about equal to the maximum radius of the conductor plus its insulation covering. Crushing forces applied to the cable jacket 11, especially in directions perpendicular to the longitudinal axis of the cable 10, will be resisted by the channels 20 which are rigid in cross-section and damage to the conductor insulation by such forces will thereby be prevented or at least minimized. Thus, when the cable is attached to an element such as a well pipe or oil recovery motor by bands or straps, a situation which often causes crushing of a cable, the band engages the outside of jacket 11 and the rigid support members 15, 16, 17 and 18 prevent damage from being done.

The channels 20 for the support members 15, 16, 17 and 18, while quite rigid and resistive to compression in directions perpendicular to the longitudinal axis of the cable 10, should also have a degree of bidirectional flexibility and resilience which can permit the cable to undergo long-radius bends as necessary when installing the cable in a service location. This can be provided by a first row of slots 30 extending inwardly through each of the channel legs 21 and perpendicularly through the joining leg 23 and terminating approximately at the bend where the leg 23 joins the opposite leg 22. The slots 30 are substantially uniformly spaced apart in the longitudinal direction of the channel and thereby divide the channel 20 into a succession of individual, flexibly interconnected channel segments. Longitudinally and alternately spaced between slots 30 is a second and opposite row of slots 31 which extend perpendicularly into the body of each channel 20 from leg 22 to the bend where the leg 21 meets the leg 23. Slots 31 are also substantially uniformly apart in the longitudinal direction, and lie approximately midway between slots 30. Thus, the slots 30 and 31 extend inwardly alternately from the legs 21 and 22, respectively, and impart greater bidirectional flexibility in the channels 20 in the major plane of cable bending; that is, in a plane perpendicular to the plane passing through the centers of the juxtaposed cable conductors 12, 13 and 14. When installed in a cable, the resulting channel structure 20 of alternately, flexibly interconnected channel segments would be similar in appearance to that shown in FIG. 1.

Figure 5:
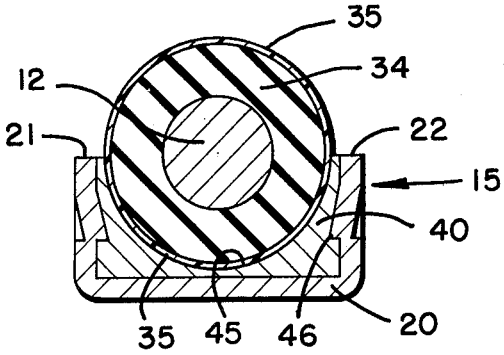
FIG. 5 is an end sectional view of a composite compression-resisting member mounted on an insulated cable conductor taken along section line 5—5 of FIG. 2.

Although the slots provide channel flexibility, the sharp edges formed in the channels 20 by the slots might abrade the electrical insulation on the cable conductors 12, 13 and 14 which are at least partially surrounded by the channels 20 of the support members 15, 16, 17 and 18 with repeated bending of these members. As best seen in FIGS. 1 and 5, each of the conductors 12, 13 and 14, which may be stranded or solid metallic conductors, are covered by one or more concentric layers or coatings of suitable electrical insulation; two such layers being shown and designated 34 and 35, respectively. These insulating coatings typically are composed of plastic or rubber components which are relatively soft and therefore may have the surfaces thereof cut or abraded by rubbing or other direct contact with harder surfaces. Any such cutting or abrasion of the conductor insulation may seriously degrade its coating and insulating characteristics.

The slots 30 and 31 cut into the channels 20 may result in sharp edges, burrs and corners being formed on the inside of the channels 20 which might abrade the softer insulating layer 35 placed in immediate contact with a channel 20, especially if the channel is formed from steel or aluminum stock.

Figure 4:
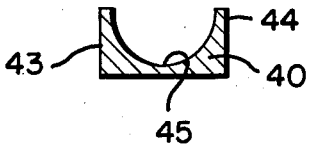
FIG. 4 is a sectional end view of a liner component for the interior of the compression-resisting member of FIG. 3.

To prevent such abrasion, an elongated liner is inserted into the U formed by channel 20. The liners, one of which is designated by the numeral 40 in FIGS. 4 and 5, have substantially flat, opposite surfaces 43 and 44, respectively, abutting and coextensive with the inner surfaces of legs 21 and 23, FIGS. 1 and 5. A semi-circular edge surface 45 is formed on the liner to conform to the cylindrical, outermost insulating layer 35. Each liner 40 is made sufficiently continuous to bridge the inner corners and edges formed by the slots 30 and 31, thereby spacing these edges from direct contact with the insulation on the underlying conductor core.

The protective liners 40 are preferably somewhat flexible so as to bend through arcs simultaneously with its overlying channel 20 in directions substantially perpendicular to the major bending plane or longitudinal axis of the cable 10. For oil well applications, the liners 40 are preferably composed of a material having good thermal conductivity to dissipate the heat applied to the cable 10 in such environments. The liner material should be relatively smooth to slide on the outermost insulating jacket 35, especially during bending of the latter. A suitable metallic material for the liners is lead, which has a smooth surface for facilitating sliding upon resilient layers of insulation and yet provides good thermal conductivity. Other suitable metallic or nonmetallic materials may also be used for the liners. The liners also afford a measure of protection to the insulation of the conductors against contact with, and possible attack by, insulation-degrading and corrosive chemicals. The central cable conductor 13, FIG. 1, is especially protected by oppositely facing, and the nearly adjoining edges of the concave surfaces 45 of the two liners which are respectively embodied in a pair of oppositely facing support members 16 and 17.

By forming each of the support members 15, 16, 17 and 18 as a composite of a channel 20 and a liner component 40 which can be inserted into the channel 20, the manufacture of the composite support members is facilitated. As is the case with the channels 20, the individual liners 40 can be manufactured by cutting the requisite lengths from a longer, continuous length of suitably sized and shaped strip of liner material.

The liners 40 may be fixedly mounted in their respective channels 20 by merely dimpling, semi-piercing or coining inwardly small surface areas on the opposite legs 21 and 22 of the channels 20 to form inwardly projecting protuberances or barbs 46. The opposing protuberances 46 cooperate to grip therebetween the upper and lower surfaces 43 and 44 of the liners 40 forcibly pressed into associated channel members with their concave surfaces 45 facing the same direction as that of the interior of the channel U.

While one advantageous embodiment has been chosen to illustrate the invention, it will be understood by those skilled in the art that various changes and modifications can be made therein without departing from the scope of the invention as defined in the appended claims.

What is claimed is:

1. An improved electrical cable comprising:

a plurality of elongated, individually insulated electrical conductors lying in one plane in substantially parallel relationship, an exterior jacket surrounding said conductors to form a cable;

a first elongated member extending adjacent and parallel to one of said conductors for resisting forces applied to said jacket in a direction substantially perpendicular to said one plane, said first member having first, second and third legs, said first leg joined to said third leg and extending therefrom adjacent a surface of the insulation on the one conductor, said third leg having a lesser compressibility in said direction than said insulation on said one conductor adjacent thereto, a second elongated member mounted on said first member intermediate said first leg and said one conductor, said first member having a plurality of longitudinally spaced slots extending inwardly thereof for facilitating bending of said third leg, said second member bridging the slots in said first member to protect the surface insulation on said one conductor.

2. The cable according to claim 1, wherein said first and second legs are substantially parallel and wherein the slots are formed in said first and second legs.

3. The cable according to claim 2, wherein the slots extend inwardly and alternately of said first and second legs.

4. The cable according to claim 3, wherein the slots extend inwardly at least into the center of said third leg, adjacent a respective one of said second or first legs.

5. The cable according to claim 1, wherein said first member is made of a rigid material.

6. The cable according to claim 5, wherein said rigid material of said first member has a good thermal conductivity.

7. The cable according to claims 5 or 6, wherein said second member has a concave surface facing said one conductor.

8. The cable according to claim 7, wherein said concave surface is smooth and continuous throughout a substantial length of said first member.

9. The cable according to claim 8 wherein said second member is composed of a material having a flexibility for bending in said plane substantially equal to that of said first member.

10. The cable according to claim 9 wherein said second member is composed of a material having good thermal conductivity.

11. The cable according to claim 10 wherein said second member is composed of a metal.

12. The cable according to claim 11 wherein said metal is lead.

13. The cable according to claim 1 wherein at least said first leg includes a plurality of inward projections for retaining said second member on said first member.

14. The cable according to claim 13, wherein said inward projections comprises a row of protuberances on portions of said first leg formed to project inwardly from said first leg to contact an adjacent surface of said second member.

15. The cable according to claim 14, wherein said first and second legs include opposite rows of inwardly extending protuberances for contacting opposite surfaces of said second member.

16. An improved electrical cable comprising:

a plurality of electrical conductors having substantially parallel, laterally spaced apart axes lying in one plane, electrical insulating material covering each one of said conductors for electrically insulating each of said conductors;

at least one elongated channel member extending substantially parallel and adjacent one of said conductors, said channel member having two substantially parallel legs lying in planes substantially parallel to said one plane, and a third leg lying in a second plane substantially perpendicular to said one plane for joining said parallel legs and being less compressible in said second plane as compared to the compressibility of the insulating material on the one conductor, the dimension of said third leg in said second plane being at least equal to the diameter of said one conductor, whereby compressive forces applied to the cable in said second plane are resisted thereby, said channel member having a plurality of spaced-apart slots extending inwardly of at least one of said parallel legs and the adjoining portions of said third leg for facilitating bending of said channel member in a second plane substantially perpendicular to said one plane, and an elongated element mounted in said channel member extending to bridge the slots for protecting the insulating material on said one conductor against abrasion by said member bending in said second plane.

17. The cable according to claim 16, wherein said channel member is of substantially U cross-sectional shape.

18. The cable according to claim 16, wherein said channel member and said element in said channel member are composed of different materials and wherein at least one of said materials has good thermal conductivity.

* * * * *